United States Patent [19]

Ayers

[11] Patent Number: 4,726,314

[45] Date of Patent: Feb. 23, 1988

[54] FAIRED UMBILICAL CABLE

[75] Inventor: Ray R. Ayers, Houston, Tex.

[73] Assignee: Shell Oil Company, Houston, Tex.

[21] Appl. No.: 682,733

[22] Filed: Dec. 17, 1984

Related U.S. Application Data

[63] Continuation-in-part of Ser. No. 516,157, Jul. 21, 1983, abandoned.

[51] Int. Cl.[4] ..... F15D 1/10

[52] U.S. Cl. ..... 114/243; 174/47; 174/101.5

[58] Field of Search ..... 114/242, 243, 244, 245, 114/251, 253, 254; 367/15, 17, 106; 264/174; 174/47

[56] References Cited

U.S. PATENT DOCUMENTS

| | | | |
|---|---|---|---|
| 2,435,956 | 2/1948 | Craig | 114/243 X |
| 2,668,512 | 2/1954 | Klas | 114/243 X |
| 3,304,364 | 2/1967 | Hetherington | 114/254 X |
| 3,611,976 | 10/1971 | Hale | 114/235 |
| 3,689,610 | 9/1972 | Nicholson | 264/174 X |
| 3,895,595 | 7/1975 | Kelly et al. | 114/243 |
| 3,992,565 | 11/1976 | Gatfield | 174/47 X |
| 4,033,279 | 7/1977 | Stiles | 114/243 |
| 4,072,123 | 2/1978 | Byers | 114/254 |
| 4,110,554 | 8/1978 | Moore et al. | 174/101.5 |
| 4,190,012 | 2/1980 | Rispin et al. | 114/243 |
| 4,196,307 | 4/1980 | Moore et al. | 174/47 |
| 4,472,598 | 9/1984 | Boyd et al. | 264/174 X |
| 4,496,796 | 1/1985 | Matikainen et al. | 174/101.5 |
| 4,569,392 | 2/1986 | Peterman | 174/47 X |

FOREIGN PATENT DOCUMENTS

| | | | |
|---|---|---|---|
| 2027553A | 2/1980 | United Kingdom . | |
| 1580089 | 11/1980 | United Kingdom . | |
| 654959 | 3/1979 | U.S.S.R. | 114/243 |

OTHER PUBLICATIONS

Bulletin 5142 of Hydril Advanced Ocean Systems, "Hydraulic Control Lines", 4/1982.

*Primary Examiner*—Joseph F. Peters, Jr.
*Assistant Examiner*—Paul E. Salmon

[57] ABSTRACT

The present invention pertains to an underwater seismic cable which has at least one tensile cable placed upstream in faired cross sectional arrangement. Located downstream of the tensile cable are placed other electrical, pneumatic and hydraulic cables and hoses, with the electrical cables being adjacent the tension cable.

6 Claims, 5 Drawing Figures

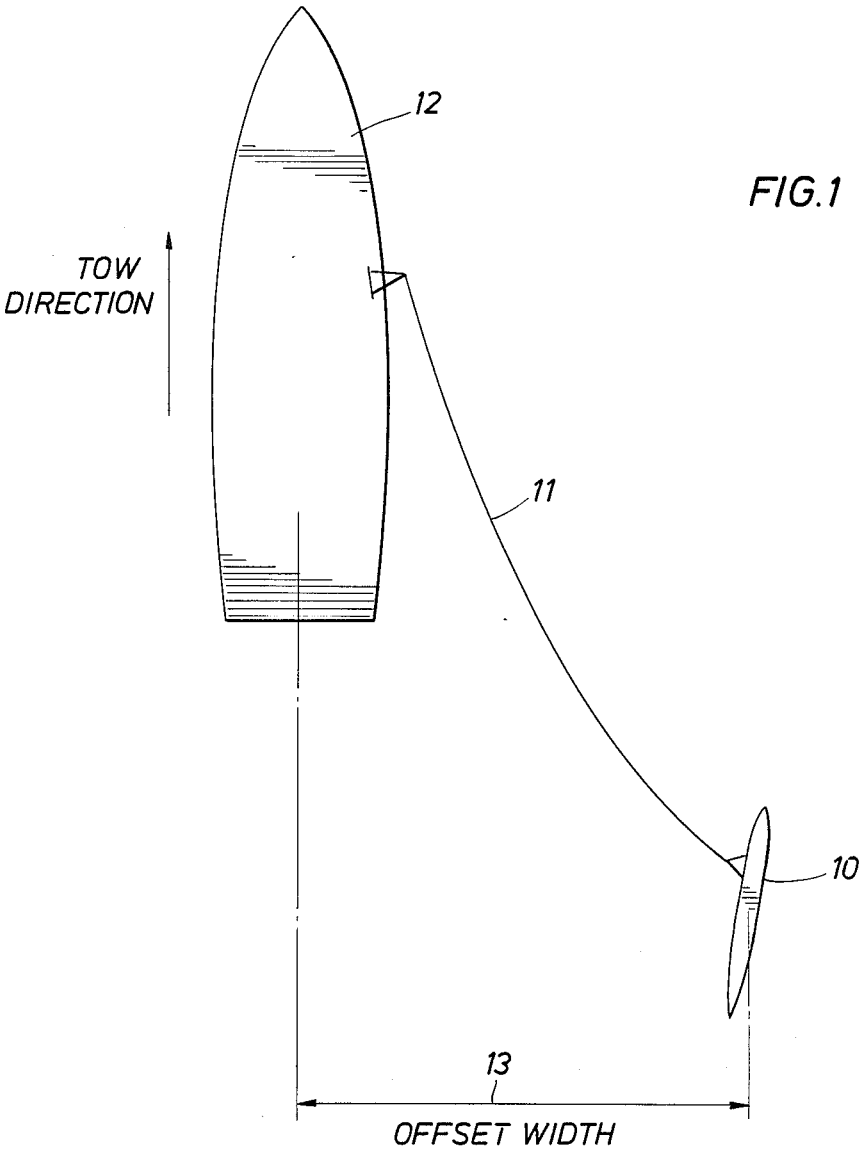
FIG. 1
FIG. 2
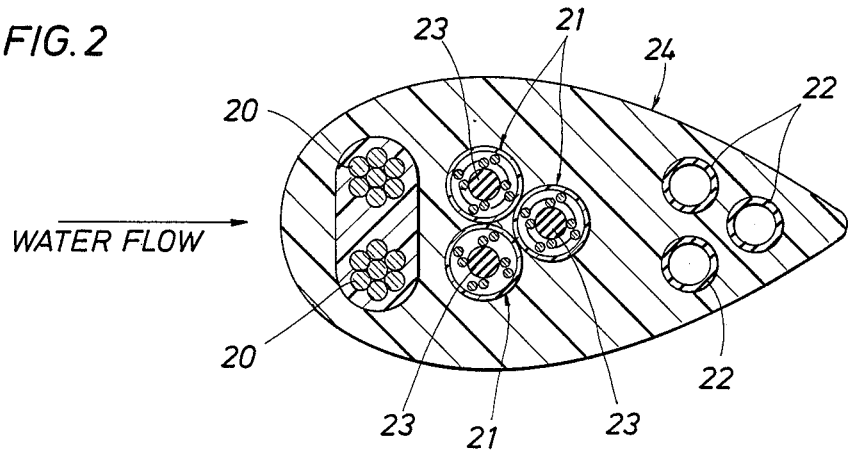

FAIRED UMBILICAL CABLE

REFERENCE TO RELATED APPLICATION

This application is a continuation-in-part of application Ser. No. 516,157 filed July 21, 1983, now abandoned.

BACKGROUND OF THE INVENTION

In offshore seismic operations, an umbilical cable is required to pull a gun array, as well as to provide air, power and electrical conductors for shooting operations. Conventional practice in this art has been to use jacketed bundles which contain various air hoses, tension cables and electrical conductors or to use armored cables containing hoses and conductors. Such bundles do not last long because tow forces, wave forces and cable handling loads reduce the structural integrity of the umbilical cable to a point where conductors break and leak. The tension cables tend to abrade the electrical conductors, particularly when the bundle is reeled around a sheave or a drum under tension. More specifically, the tension cables tend to put point pressures on the electrical conductors, causing breakage and insulation leakage. This problem has been recognized heretofore, and one solution has been to use a discrete wire rope tension cable as a "clothesline" from which to intermittently tie a round jacketed bundle of electrical cables and air hoses. Thus, the wire rope cable provides the tensile strength, and the electrical/air bundle adjacent to it is not significantly loaded in tension. This method has worked reasonably well as long as the bundle can be drawn up "accordian style" without reeling it up. But, as longer and longer cables are needed for towing gun subarrays further outboard of the tow vessel, the compacted clothesline bundle is too long and causes too much drag to be effective and practical. Another problem with this method is that very short-radius bends form in the bundle, and as the cycles of the bends increase, the bundle life is decreased.

An alternative to the cable/bundle system is to use an umbilical cable with tension wires, conductors and air hoses cabled into a single "cable". The problem with this is that cyclically bending these cables around sheaves causes the wires to crush the conductors and hoses reducing cable life due to leakage.

Still another alternative is to build an armored cable with an outer-shell tension member, and hoses and electrical conductors within. This is feasible from a strength standpoint and is reelable but has several problems: first, the umbilical cable is excessively heavy; second, the terminations are difficult to seal; and third, the cables are expensive to replace and have questionable reliability.

Still another serious problem with all of the above-mentioned umbilical cable designs is that they tend to have a large overall diameter as well as a poor cross-sectional shape, thus causing high drag forces. The problem with high drag has come about because of increasing requirements to tow guns in a wide array and at higher speeds as shown in FIG. 1, and more particularly discussed hereinafter, as contrasted with narrower widths used previously.

An umbilical referred to as Flexpak TM is manufactured by Hydril Corporation (Bulletin 5086). The Flexpak TM umbilical tends to "cup" into flow inasmuch as it utilizes tensioning cables at both extremities and is not the equivalent of the present invention.

An umbilical with a faired shape referred to as Flexnose® is manufactured by Fathom Oceanology Ltd. (brochures MSK 4, September 1976 and MSK 61, August 1976). The Flexnose® is a preformed clip-on or clip-together and is not equivalent to the integrally molded faired umbilical of the present invention.

SUMMARY OF THE INVENTION

The primary purpose of the present invention is to provide an underwater cable which has a low drag coefficient when deployed outboard of a tow vessel. Another purpose of the present invention is to provide a reliable underwater cable which is capable of being turned around a sheave while under tension and of being wound upon a reel without damage to the cable. Preferably, the cable is an umbilical seismic cable.

In achieving the purposes of the present invention a cable suitable for underwater towing is provided in which conductors are covered by a continuously extruded jacket having a faired cross section. Even more preferably, a cable is provided which includes electrical conductors, pneumatic hoses and a tension member arranged side-by-side inside a jacket, the tension member being axially stiffer than the adjacent hoses and conductors. Even further, a cable is provided which has relatively untensioned conductors twisted around a soft, flexible core member, with the jacketed assembly of conductors being arranged side-by-side with the tension member. Preferably, the cable is a seismic cable.

BRIEF DESCRIPTION OF THE DRAWINGS

FIG. 1 is a plan view of a wide subarray configuration.

FIGS. 2 and 3 are cross-sectional views of cable configurations.

DESCRIPTION OF PREFERRED EMBODIMENTS

Figure 3:
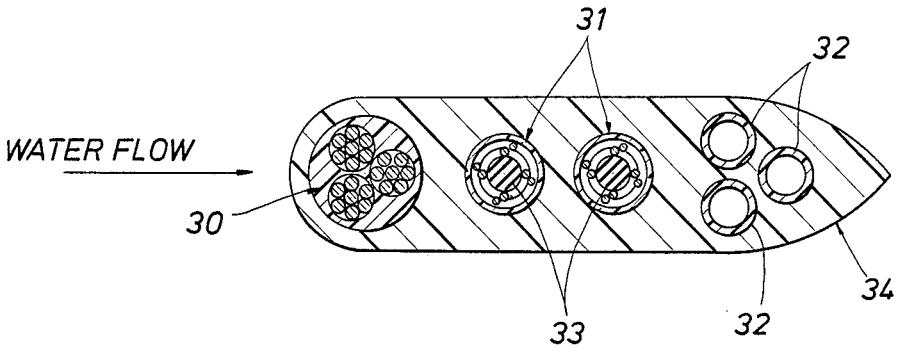

As shown in FIG. 1, a subarray 10 is towed with an umbilical seismic cable 11 at a position which is well outboard from vessel 12. While multiple floats are normally used, only one is shown here for Purposes of illustration. It is often desired for seismic studies to tow floats far outboard on either side of the tow vessel. The offset width 13 is directly affected by the fluid dynamic drag forces experienced by umbilical cable 11. Accordingly, the solution of the present invention to the problems of getting greater offset width is to provide a specially-built faired cable design with a tension member or tension members located at the forward or leading edge of the cross section thereof. Two examples of this concept are shown in FIGS. 2 and 3. The faired cable construction is like an airplane wing shape with the purpose being to reduce drag. A round cable has a drag coefficient of about 1.2 to 1.3, depending upon its linear diameter. A flat cable with the same thickness has a drag coefficient of perhaps 0.13, an order of magnitude reduction in drag.

The tension members 20 and 30 in FIGS. 2 and 3 are at the forwardmost locations followed by the electrical cables 21 and 31 and air hoses 22 and 32. Tension members 20 and 30 are preferably antitorsional steel wire rope so that when the umbilical cable is under load it doesn't tend to twist and is very torsionally stable. Next to the tension members are the electrical bundles 21 and 31. These bundles are purposely designed to be much more flexible in the axial direction than the tension members 20 and 30. It is preferable to use twisted pairs of insulated conductors which are twisted around each other and then layered around a circle. A soft insert 23 and 33, such as soft rubber, is inserted in the middle of the circle so that it acts much like a Chinese thumb-puller in that it has enough softness that when the cable is pulled, it will contract radially, and then when tension is slacked off, it expands. The electrical conductors 21 and 31 are not tightly nestled. The twisted pairs of conductors in each layer are not placed too close together so that the electrical conductors can flex, resulting in an axially soft cable.

The next member in the cable aft of the tension member and the electrical bundles are air hoses 22 and 32. The air hose also is designed to be axially flexible. Some of the air hoses may be used for hydraulic hose as needed.

Tension members 20 and 30 can be coated with a soft coating to make them round and, where there is more than one cable, they can be circled together as shown in FIG. 2 or placed side by side as shown in FIG. 3. In addition, electrical bundles 21 and 31 can be jacketed with a soft coating material. The three elements, tension members, electrical bundles and air/hydraulic hoses, are passed through an injector mold having a faired shape and the outer plastic jacket 24 and 34 are molded. Nitrile rubber or polyurethane are preferred materials, both being durable and flexible.

Figure 4:
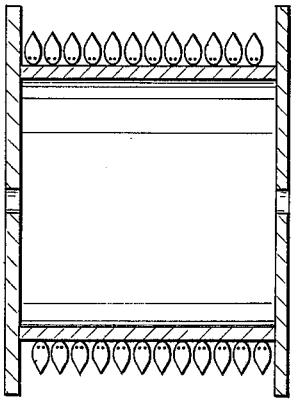
FIGS. 4 and 5 are cross-sectional views of various cable reel-ups.
Figure 5:
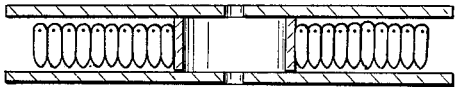

The two umbilical designs in FIG. 2 and 3 behave somewhat similarly due to water flow around them, but they are reeled up for storage in different ways as shown in FIGS. 4 and 5. The faired flat design can be rolled up like a single ribbon as shown in FIG. 5, while the multiple tension cable umbilical shown in FIG. 4 will automatically roll up with the nose toward the drum. It is wise to provide adequate reel width to avoid multiple layers of the cable of FIG. 4 on the reel. It is important to design the air and electrical components of the cables to be extremely flexible in axial extension and compression so that reeling the cable on a drum will not cause excessive stresses. The faired umbilical design as shown in FIG. 5 can be reeled under a much lower strain condition than the multiple tension cable umbilical design of FIG. 4. This is because the bending axis, or pitch axis, of the electrical components 21 and 31 and air hose components 22 and 32 coincide with the bending axis of the tension member components 20 and 30.

The tension members 20 and 30 are torque balanced so that the cable does not twist under varying axial load conditions. This is particularly important for the flat, faired design of FIG. 5. In the design of FIG. 4, the multiple paired cables can be combined with opposite lays to ensure structural symmetry and thus avoid undesirable twisting.

A further advantage of the cable of FIG. 5 is that it can be rolled up on a ribbon reel, meaning that it can be rolled layer on top of layer, but it is not necessary to have it layer beside layer as in winding up the cable of FIG. 4. Therefore, it is possible to have a very thin roll of large diameter as compared to a thicker reel of smaller diameter. There is another major advantage of this cable in the reaction of the tension member into the reel without having to load up any of the conductors. By comparison, with a round cable, the load in the tension member will squeeze the conductors in the process of feeding into the reel. This is effectively taken out of the design as shown in FIG. 5 so it can be used with outrigger reels. The advantage is that the load is not fed through the electrical conductors, but the electrical conductors, air hose, and anything that is put in the cable, in effect, just go along for the ride and the tension member takes all the tension.

Historically, faired cables have been formed by mechanically attaching discrete foil-shaped segments to a round, usually armored, umbilical cable. These attachments were made in such a way that the fairings can freely rotate around the round umbilical cable. Early problems were encountered when the fairings interfered with each other so that they would not rotate as freely as desired. The result is that a submerged towed body depending from this faired cable would flare to one side or the other, rather than stay in a vertical plane.

As above indicated, in reference to FIGS. 4 and 5, the cable of this invention utilizes a torque-balanced wire rope tension member to which the elongate and not discrete faired portion is locked by molding to the tension member in situ, e.g. by injection molding. A torque-balanced, or non-rotating, cable has the property that if a weight is suspended from such a cable (as with a crane lifting a load), the load will not appreciably rotate, regardless of the magnitude of the load. The torque-balanced feature is created during manufacture by alternating the lay directions, lay angles and cable strand properties in such a way that the cable thus formed has an inherent resistance to twisting. That means that if the suspended load previously mentioned is rotated, or twisted, by separate means, the load will eventually untwist to its previous untwisted condition.

This property of the torque-balanced cable is particularly important in the subject invention when the faired cable is used to tow floating bodies far outboard of a tow vessel, rather than to tow a submerged body, or seismic fish, below and directly behind the towing vessel. If the cable leaves an outrigger sheave with the tension member holding the remainder of the cable below it, as caused by the force of gravity, the faired cable will tend to pierce the water's surface with the pointed (downstream) end of the cable down. But the force of the water will flare the cable downstream, making the length of the cross section more parallel with the mean surface of the water. But the effective weight of the rest of the faired cable, acting about the fixed tension member, will continue to cause the downstream end of the faired cable to be lower than the upstream end, therefore causing the faired cable to tend to plane near the surface of the water, reducing drag. The function of the locked-in torque-balanced cable, suspended from the towing vessel as described previously, is to impart a planing motion to the cable by virtue of the torsional resistance of the torque-balanced cable, unattainable by conventional cables using conventional fairings.

The cable design of U.S. Pat. No. 4,072,123 (Byers) in FIG. 9 has no torque balancing feature because it consists of a plurality of strength members, or strands, positioned in a parallel rather than twisted form. Further, Byers' FIGS. 5 through 8 disclose tension members of flat cross section. Because the flat dimension is parallel to the length of the cross section, the flat tension member will tend to rotate 90 degrees (left or right), rather than stream downstream as shown. The tendency of flat tension members, like ribbons, to flutter crossways to the flow is well known to those skilled in the art. The result is that the designs disclosed in FIGS. 5 through 8 will not stream in the water properly.

The cable of Byers' FIG. 9 has several deficiencies in comparison to the present invention. When the Byers cable is stored on a reel, such that the length axis of the cross section is parallel to the axis of the reel, the tension strands 98 and the conductors 100 will buckle on the side closest to the reel axis, causing a subsequent delamination of the layered construction. Concurrently, the strands fartherest from the reel axis will either break or try to move to a new location closer to the reel axis (but still within the cable). The problem is analogous to trying to reel a length of ribbon-like webbing around a reel so that the long dimension of the cross section is perpendicular to the axis of the reel. Clearly, the ribbon will tend to flop over, especially if the webbing is being réeled in under high tension. Thus, the cable design of Byers' FIG. 9 will tend to self-destruct as the cable is reeled in and reeled out a number of times. The solution to the problem of Byers would be to use the reeling procedure described in the present invention, in which the cable is reeled in with its "nose" toward the reel axis, and its "tail" away.

If the cable design of Byers' FIG. 9 is used for anything but a bottom tow cable, it will not tend to plane near the surface like the cable design of the present invention (refer to above discussion of the benefit of torque balancing). For the cable to stream outboard of a tow vessel properly, as in towing floating bodies, the part of the cable cross section behind, or downstream of the tension member must be heavier than the portion in front. More specifically, the effect of gravity on the submerged cable must cause the downstream end of the cross section to be lower than the upstream end. Conversely, if the downstream end is too light, perhaps caused by a void as shown in Byers' item 101, the cable will tend to dive, with the consequence of significantly increasing drag forces.

Yet another problem of the Byers invention is that the built-up cable must not be so soft that the cross section is crushed when the cable is wound under tension upon a reel. The design of Byers' FIG. 9 has soft components which would crush under the substantial loading of multiple wraps of cable on a drum. This problem is known to the art, and many cables and even cores of the reels have been crushed. In addition, if the faired section is to be reeled up, it should have parallel sides of the cross section, particularly near the tension member and the electrical bundle behind. The parallel portions of the cross section facilitate adding one layer after the other, without causing undue stress concentrations where adjacent convex sides contact each other.

The result of extrusion of a thin jacket over components that comprise an already faired shape is that the jacket will not fit tightly around that shape, and it will eventually delaminate, causing breakage and water intrusion. In contrast, a jacket extruded over a round shape can be fit quite securely. The solution of the present invention is to compression mold a faired shape over generally round components.

With respect to the torque-balanced cable of the present invention, it is considered good practice to compression extrude a thin, round jacket over the wire rope cable, so that the polyurethane or thermoplastic rubber, or the like, achieves an adequate bond or adhesion to the wire rope. The compression extrusion process involves the use of high pressure in the extruder head to force the extruded material onto the wire rope. In contrast, if the jacket is tube extruded, the extruded material is pulled over the wire rope leaving voids, thus reducing bonding. Finally, the jacketed wire rope cable, jacketed electrical bundle, and jacketed air hose are used as components over which the faired jacket is compression extruded.

The present invention is useful not only as seismic cable as above described but also can be utilized in connection with other towed bodies, e.g. a submarine. In addition, by changing the orientation of the faired cross-section of the cable from horizontal to vertical, or some orientation therebetween, it can be used to connect towed bodies which are directly or more directly behind and below the towing vessel.

The foregoing description of the invention is merely intended to be explanatory thereof. Various changes in the details of the described apparatus may be made within the scope of the appended claims without departing from the spirit of the invention.

What is claimed is:

1. A seismic cable suitable for underwater towing comprising a torsionally resistant torque-balanced tension member having cable strands arranged with alternating lay directions and lay angles to be resistant to twisting, an electrical bundle and an air hose arranged side-by-side and spaced apart by a continuously elongate, flexible jacket which is in situ molded between and around and thereby locked to the tension member, electrical bundle and air hose, the jacket having a faired shape and the tension member being in the leading edge of the in situ molded jacket.

2. The cable of claim 1 wherein the electrical bundle comprises conductors twisted around a soft insert.

3. The cable of claim 2 wherein the soft insert is functional to contract radially under tension and the twisted conductors have sufficient slack to flex with the tensionable insert.

4. The cable of claim 1 wherein the jacket is in situ injection molded about the tension member, electrical bundle and air hose.

5. The cable of claim 1 wherein the tension member, electrical bundle and air hose are generally round components and the jacket is a faired shaped compression molded over the round components.

6. The cable of claim 1 including at least two tension members arranged side-by-side in the leading edge of the integrally molded jacket and equidistant from the electrical bundle.

* * * * *